US008360272B2

(12) United States Patent
Piersant et al.

(10) Patent No.: US 8,360,272 B2
(45) **Date of Patent: *Jan. 29, 2013**

(54) BOTTLED WATER CENTER

(75) Inventors: Rodger Piersant, Dalton, GA (US); Richie Morrison, Dalton, GA (US); Andy Michaud, Dalton, GA (US); Jim Gibbons, Dalton, GA (US)

(73) Assignee: DS Waters of America, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/344,542

(22) Filed: Jan. 5, 2012

(65) Prior Publication Data

US 2012/0173016 A1 Jul. 5, 2012

Related U.S. Application Data

(63) Continuation of application No. 12/492,854, filed on Jun. 26, 2009, now Pat. No. 8,113,382.

(51) Int. Cl.
*G07F 11/00* (2006.01)

(52) U.S. Cl. ..... 221/102; 221/66; 221/151; 221/156

(58) Field of Classification Search ..... 221/66, 221/102, 151, 156, 97
See application file for complete search history.

(56) References Cited

U.S. PATENT DOCUMENTS

| | | | | |
|---|---|---|---|---|
| 3,179,224 | A | 4/1965 | Haupt, Sr. et al. | |
| 4,207,973 | A | 6/1980 | Stampleman | |
| 4,573,641 | A | 3/1986 | DeWoolfson et al. | |
| 4,717,026 | A | 1/1988 | Fischer et al. | |
| 4,919,274 | A | 4/1990 | Hammond | |
| 5,161,661 | A | 11/1992 | Hammond | |
| 5,355,987 | A | 10/1994 | DeWoolfson et al. | |
| 5,361,913 | A | 11/1994 | Melchionna | |
| 5,829,630 | A * | 11/1998 | Fernald | 221/66 |
| 6,192,296 | B1 | 2/2001 | Colmant et al. | |
| 6,206,237 | B1 * | 3/2001 | Dillon et al. | 221/289 |
| 6,474,502 | B2 * | 11/2002 | McCord et al. | 221/131 |
| 6,834,691 | B2 | 12/2004 | Goldin | |
| 7,213,722 | B2 * | 5/2007 | Nagelski et al. | 221/246 |
| D566,920 | S | 4/2008 | Boydston et al. | |
| 7,909,206 | B2 * | 3/2011 | Davis, Jr. | 221/124 |
| 7,975,875 | B2 | 7/2011 | Borzym | |
| 8,113,382 | B1 | 2/2012 | Piersant et al. | |
| 2002/0043509 | A1 * | 4/2002 | Lajeunesse et al. | 211/59.2 |
| 2007/0012541 | A1 | 1/2007 | Boydston et al. | |
| 2008/0121492 | A1 | 5/2008 | Kreitz et al. | |
| 2008/0308383 | A1 | 12/2008 | Boydston et al. | |

OTHER PUBLICATIONS

United States Patent and Trademark Office, Non-Final Office Action, U.S. Appl. No. 12/492,854, mailed Jul. 25, 2011, 6 pages.
United States Patent and Trademark Office, Notice of Allowance, U.S. Appl. No. 12/492,854, mailed Nov. 14, 2011, 5 pages.

* cited by examiner

*Primary Examiner* — Timothy Waggoner
(74) *Attorney, Agent, or Firm* — Perkins Coie LLP

(57) ABSTRACT

A bottle return station preferably with a dispensing station provides for the receipt of empty bottles. Bottles are provided through an acceptor which accepts bottles having a particular configuration while not accepting others. The empty bottle returns are guided to a receiving station where they can be retrieved by an operator. Meanwhile a dispensing station can be accessed by users.

26 Claims, 5 Drawing Sheets

BOTTLED WATER CENTER

CROSS-REFERENCE TO RELATED APPLICATION

This application is a continuation of U.S. application Ser. No. 12/492,854 filed Jun. 26, 2009, which is incorporated herein by reference in its entirety.

FIELD OF THE INVENTION

The present invention relates to a kiosk or center configured to retrieve water bottles in a presently preferred embodiment, and possibly dispense water bottles as well.

BACKGROUND OF THE INVENTION

U.S. Pat. No. D566,920 owned by Prima Water Corporation of Winston Salem, N.C., is directed to a bottle return apparatus which is configured to receive empty bottles in a cage until picked up by an operator. This bin is believed to be configured to dispense a ticket to a customer for the customer to take to the checkout counter for credit in redeeming the empty bottle. While this is certainly one way of conducting water bottle business, there is believed to be room for improvement in the water bottle exchange business.

SUMMARY OF THE INVENTION

The present invention relates to equipment utilized with bottle supply and/or return systems.

An object of many embodiments of the present invention relates to an improved bottle return center.

Another object of many embodiments of the present invention relates to an improved bottle supply center.

Another object of many embodiments of the present invention is to provide an improved water bottle return system although similar technology could be applied to the propane bottle supply and return industry as well.

Another object of many embodiments the present invention is to provide an improved method of receiving empty bottles such as water bottles.

Another object of the presently preferred embodiment of the present invention is to provide an improved organizational system for storing empty bottles while potentially allowing or providing access, such as selected access to filled bottles.

It is another object of many embodiments of the present invention to provide for an improved water bottle center for dispensing and/or receiving water bottles.

Accordingly, in the presently preferred embodiment of the present invention, a bottle center or kiosk is provided with a return station in which an empty bottle is placed at an elevation at a return acceptor. Once admitted through the acceptor, the bottle is preferably guided with guides taking into consideration circular cross sectional portions of the exterior of the bottle to assist in directing the bottle in a designed manner with gravity assisting in feeding the return toward a removal location. As more bottles are placed through the return acceptor location, then the bottles preferably stack sequentially beginning at the return retrieval location.

Furthermore, in the preferred embodiment, the return axis location is provided with an interlock at the acceptor which can block the insertion of return bottles not oriented in a desired position and having a desired cross sectional perimeter. This interlock also may prevent unauthorized removal of bottles which have been inserted.

In still other embodiments, in addition to a retrieval system, a distribution station is provided which filled bottles are available for purchase are presented preferably in an orderly fashion for purchase by consumers. These bottles may, or may not, be preferably oriented so that they will not roll from one position to another.

One or more processors can be coordinated with sensors and/or switches to ascertain the position of at least some of the bottles such as to detect removal and/or stocking issues. The electronic components can be coordinated with at least one processor in order to make a water center which is a point of purchase sale center such as by receiving credit card payment to then possibly allow the removal of particular bottles. Still other embodiments may detect a return and possibly discount the price for a full bottle and/or identify when a number of the initial supply is depleted therefore advising an operator of a need to restock the supply.

The electronic version could also effectively count the number of retrieved bottles to identify when the center needs to be cleared to have at least some of the return bottles removed from the station.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
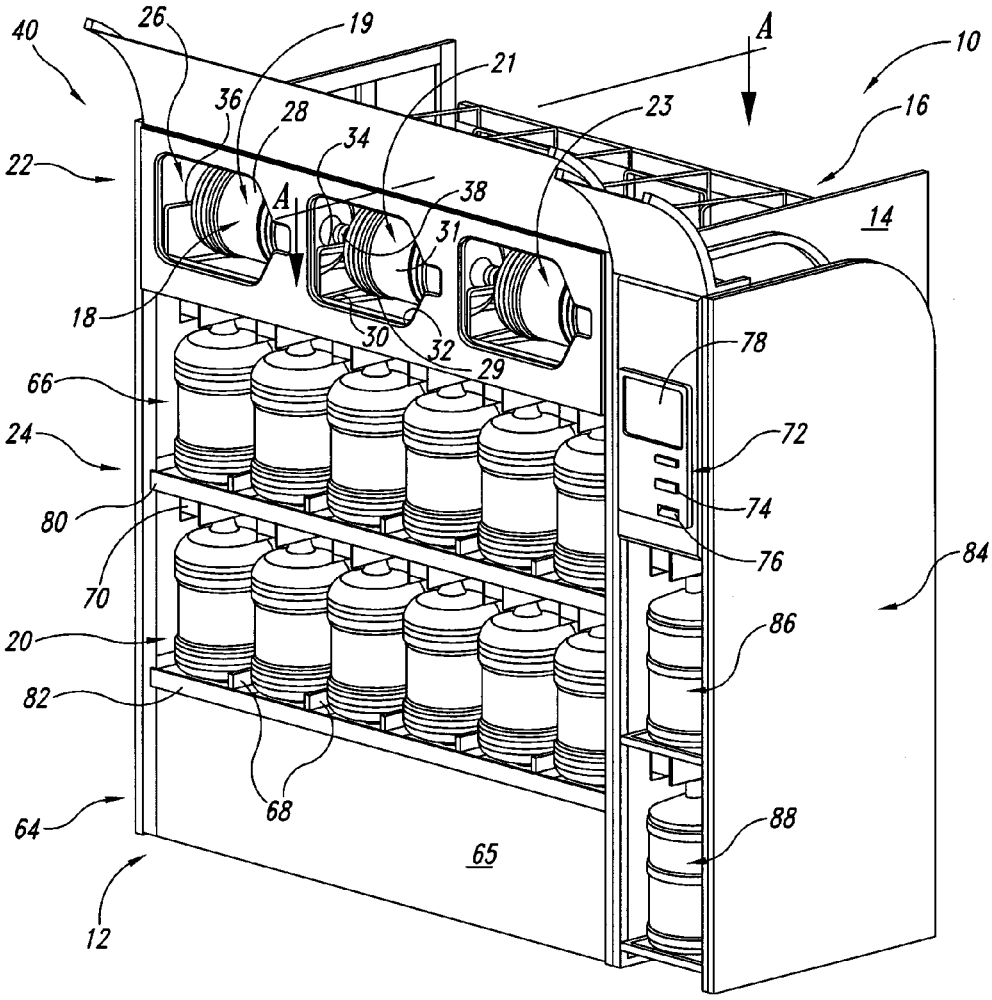
FIG. 1 is a front perspective view of a kiosk constructed in accordance with the presently preferred embodiment of the present invention.
Figure 3:
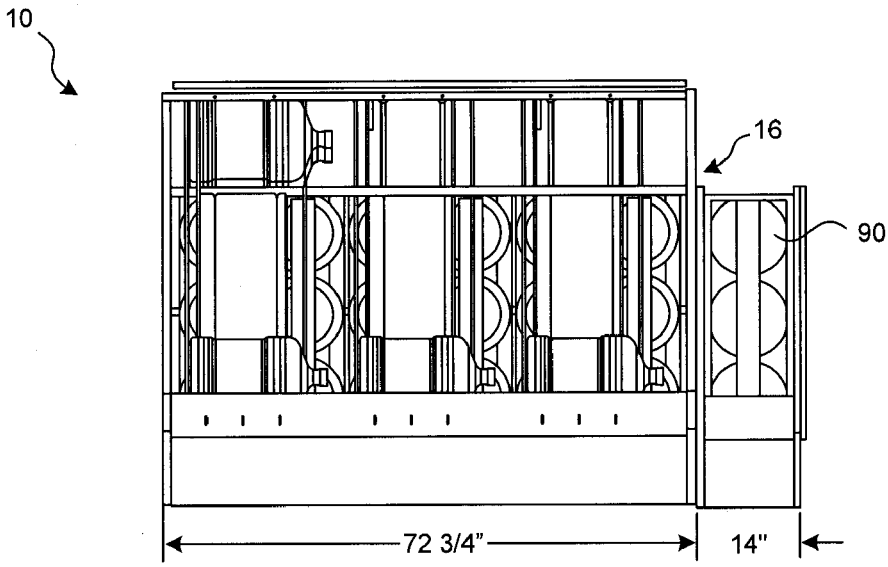
FIG. 3 is a back view of the kiosk of FIG. 1.
Figure 4:
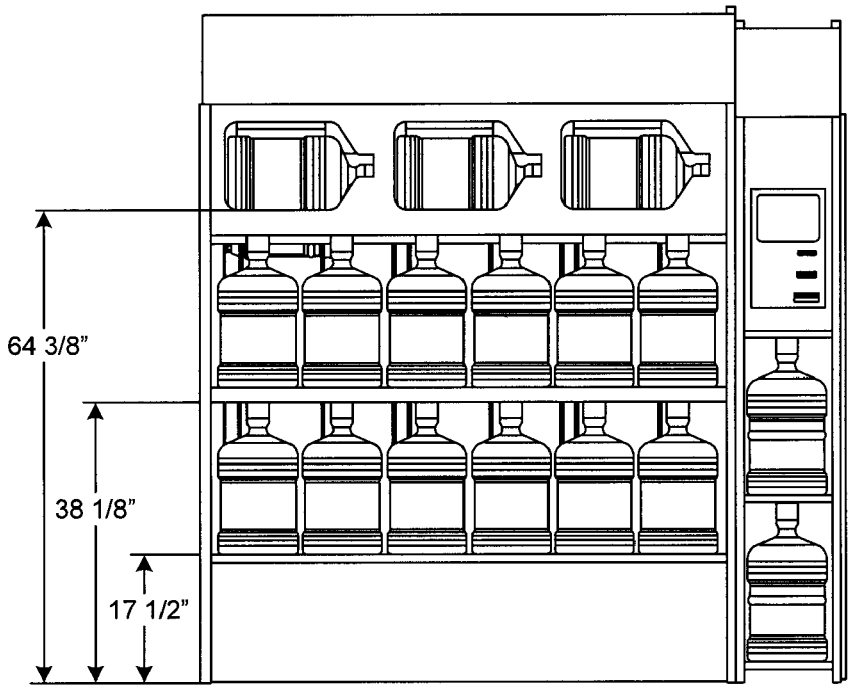
FIG. 4 is a front view of the kiosk of FIG. 1.

FIG. 1 shows a kiosk 10 having a first side or front 12, sides 14 (opposing side not shown) and back 16 as better seen in FIG. 3. The kiosk 10 preferably receives returns 18. It may also assist in dispensing a supply of stocked units 20.

The kiosk 10 preferably accepts the returns 18 initially at return station 22 which is illustrated beginning at an elevation above dispensing station 24 but may not necessarily be in all embodiments. Dispensing station 24 may not form a portion of all embodiments of kiosk 10.

The dispensing station 22 is preferably located at a sufficient elevation for at least some embodiments to allow for gravity to assist in movement of returns 18 as will be discussed in further detail below. The return station 22 is preferably provided with one or more acceptors 26 which preferably provide a perimeter 28 which can accommodate a desired return such as a water bottle or a propane bottle, etc., of a predetermined configuration and/or orientation while at least in some embodiments preferably rejecting the acceptance of other returns. Returns 18 are preferably empty bottles. For example, in the preferred embodiment the acceptors 26 accept five gallon water bottles but reject or refuse to accept two and one half or three gallon water bottles. Other embodiments may not provide for selective acceptance of returns. The return feature at acceptor 26 will be discussed in further detail in reference to FIGS. 5, 6 and 7 below particularly as it relates to the acceptance or rejection of returns.

Upon entering the return station 22, the returns 18 illustrated as bottles are preferably supported by one or more guides illustrated as bottom tracks 30,32 contacting circumference 29 of bottle side 31. In fact, cooperating guides illustrated as side tracks 34,36 are also useful with side track 34 providing a location on which dispensing end 38 of bottle illustrated return 18 may also be supported at least at some portion from below and/or provide for side support and/or direction of the return 18 at least along first stage 40 of the return system.

The first stage 40 as preferably provided utilizes gravity by having a higher elevation at first point 44 than second point 42 so that the bottles are fed at least partially by gravity towards the back 16. Other embodiments may operate differently.

Gravity feed can also assist at the second stage 46 in which side directors 48,50 and/or 52 cooperate can assist in keeping the returns 18 in alignment as they proceed downwardly towards a lower or bottom portion of the kiosk 10 such as to third stage 50. Once again, side directors 52,54 can assist in directing the returns towards the desired location. Elevation at point 56 can be higher than that at point 58 along a continuous plane 60 which could be somewhat similar to continuous plane 62 to assist in that downward direction to possibly allow gravity to at least assist in moving the returns 18 such as by rolling to their desired storage position.

Figure 2:
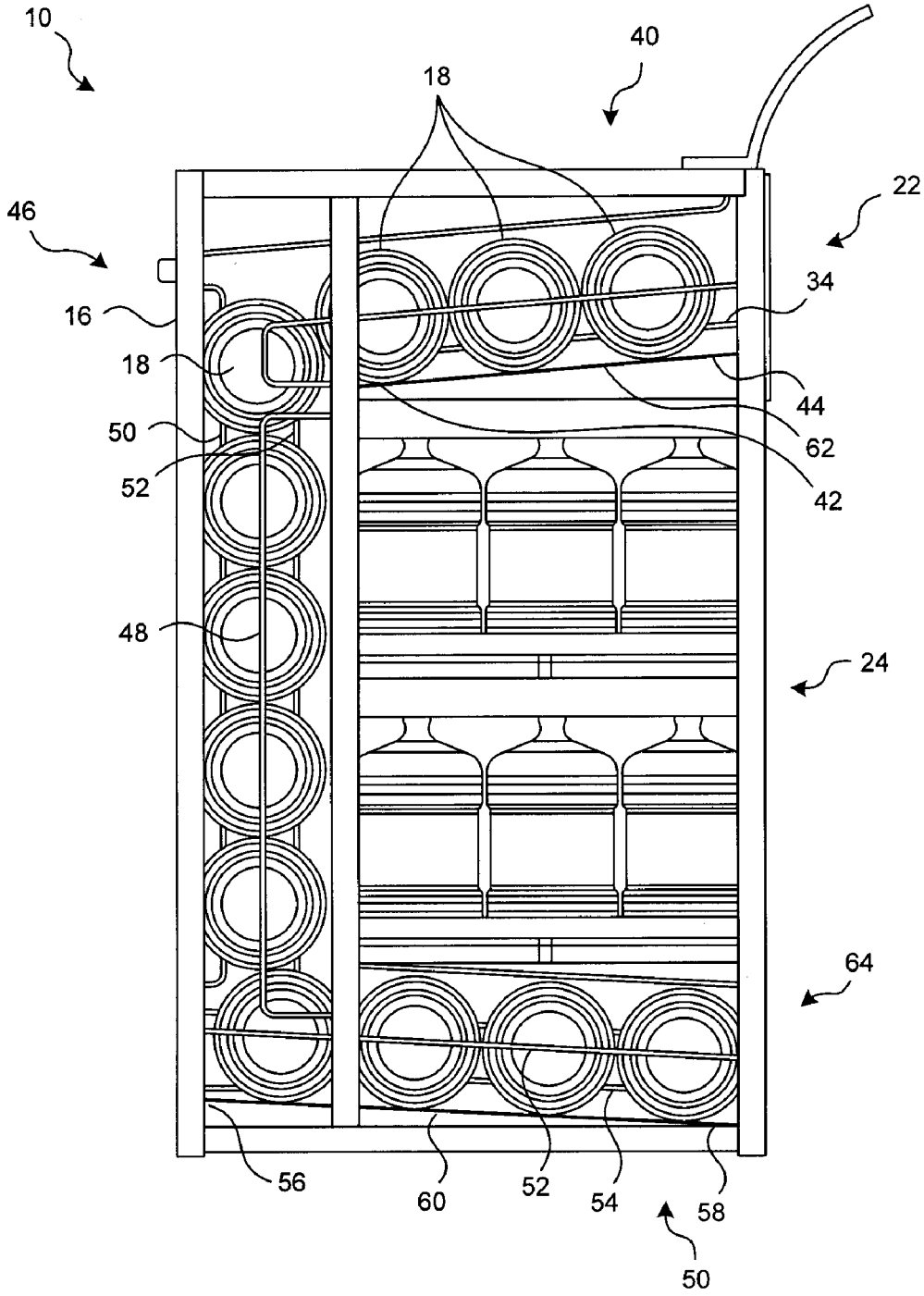
FIG. 2 is a cross sectional view taken along line A of FIG. 1.

FIG. 2 shows all twelve returns as a possible maximum number of returns 18 in one lane 21 of the return station 22 awaiting retrieval through recovery station 64. The illustrated the embodiment the return station 22 begins above the dispensing station 24 and terminates below the dispensing station 24. Dispensing station 24 may be provided with at least one row 66 illustrated, such as with six stock units across which are three in depth which can be seen by reference to FIG. 2. There are also two columns high as illustrated. Dividers 68 may be useful for supplying stocked units 20 in a neat organization 66 towards the bottom of opposing sides of stocked units 20. Furthermore, head receivers 70 may be useful to direct the upper portion of the bottle and possibly prevent removal of the stocked units 20 until payment has been made at processor 72 in some modes of operation which could include a credit card input 74 and/or a ticket dispenser 76 with screen 78 along with possible other components. With such a set up as would be understood by those of ordinary skill in the art, cooperation with sensors such as in the head units 70 on or with the shelves 80,82, and or acceptor(s) 26, the processor 72 could assist in receiving and/or dispensing. The processor 72 could also predict anticipated locations of the stocked units 20 such as the stocking configurations shown in FIGS. 1 and 2. Processor 72 can detect the location of stocked units 20 at the dispensing station 24 at least for some embodiments. Processor may also detect a return 18 possibly through acceptor(s) 26. Additionally, side station 84 may provide one or more additional locations for stock units 86,88 as well as additional stocked units 90 as shown in FIG. 3 which may or may not be accessible to a customer. An operator may be required to move stock units 90 to dispensing station 24 to be stock units 20.

The return station 22 may also be equipped with sensors to advise the processor 72 of whether or not an empty has been returned to the kiosk 10 based on whether or not an empty has been returned or not. This may affect pricing of stock units 20 at processor 72 in some modes of operation.

Back 16 shows various components in FIG. 3.

The return station 22 preferably receives from the first lane 19 and second lane 21 and the lane 23 but all station lanes 19,21,23 need not be utilized in all embodiments. Furthermore, additional lanes 19,21,23 could be provided in other embodiments. The first stage 40 may provide gradual and/or sequential acceptance of an empty return 18 and direct return 18 towards second stage 46 at which the empty can descend down towards the third stage 50 which is where an operator may relatively easily remove the empties from a station 64 when in a removal configuration. Second stage 48 is illustrated at a steeper grade of descent than first and second stages 46,50 in this embodiment. Other embodiments may differ. The first stage 40 is shown as extending a distance above the receiving station, the second stage 46 extends fully behind the dispensing station 24 and the third stage 50 is shown completely below the dispensing station 24 in the preferred embodiment. Other embodiments may have other configurations in an accept configuration.

Figure 5:
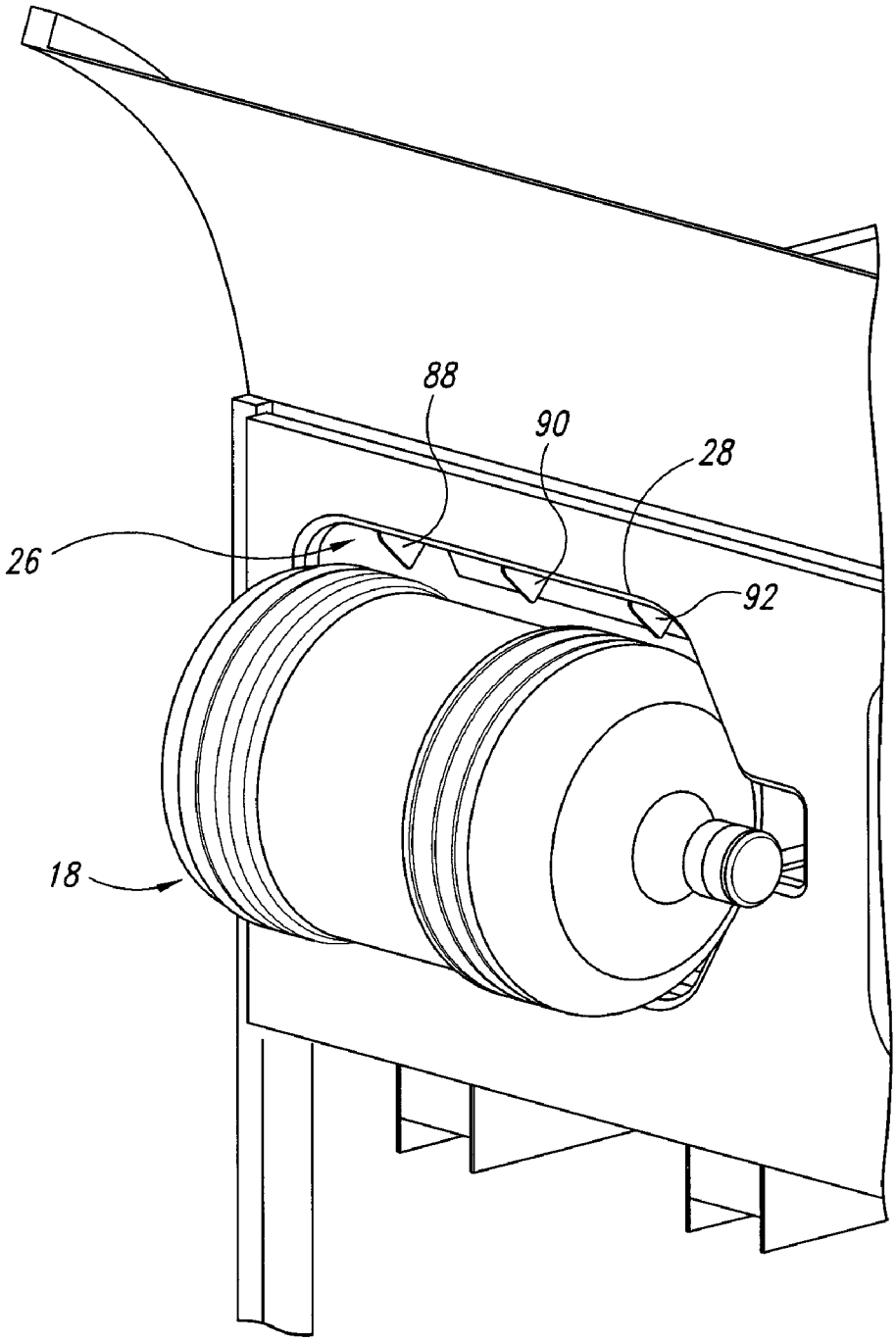
FIG. 5 is a detailed view of detail B shown in FIG. 1.

FIG. 5 shows the receipt of a return 18 in accordance with a preferred embodiment of the present invention. Specifically, return 18 is directed through acceptor 26 having perimeter 28. If the return 18 has a cross section configuration which will not cooperate with the perimeter 28 at a desired orientation, then the return will be rejected. Furthermore, stop mechanism 86 may include a plurality of stop latches 88,90,92. In the preferred embodiment, all the stop latches 88,90,92 must contact the return 18 such as with the contacts 94 on exterior surface 96 such as simultaneously or otherwise for the rotation of the latches 88,90,92 about one or more pivots 98 so that catches 100 disengage stop plate 102 to allow for the return 18 to pass through acceptor(s) 26 by stop mechanism 86 so that it is no longer blocked by stop plate 102.

In the illustrated embodiment, the stop mechanism 86 allows for the acceptance of five gallon jugs to be provided in the correct orientation. Preferably, all three stop latches 88,90,92 must be engaged to allow for the stop plate 102 to move to a receive or accept configuration from a blocking configuration. Other embodiments may function differently. Three gallon jugs and/or bottles turned the wrong way will not engage all of the stop latches 88,90,92 and thus will not allow such a return to pass through the acceptor 26 even if they could fit through perimeter 28.

Figure 6:
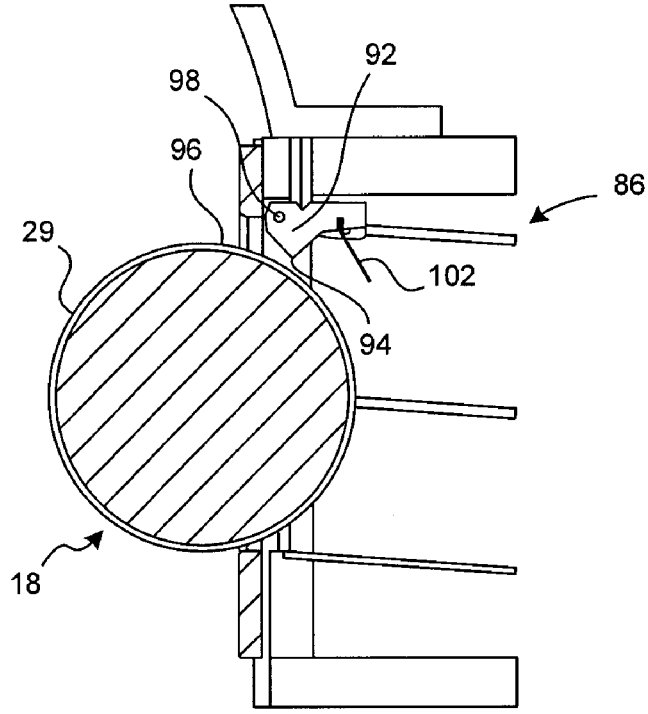
FIG. 6 is a cross sectional view taken along the line C-C of FIG. 5 as a return bottle shown in FIG. 5 is inserted into the initial receiving station.
Figure 7:
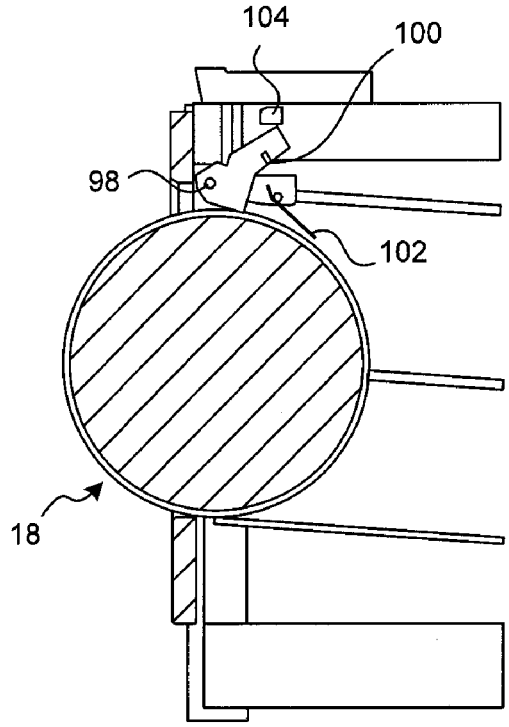
FIG. 7 shows the bottle as shown in FIGS. 5 and 6 moving past a latch interlock thereby accepting a return bottle.

As shown in FIG. 6, a return 18 which initially contacts the contact 94 allows for a latch 92 to rotate about pivot 98 to then allow the stop plate 102 to move as described above. With the processor 72 provided with a signal from a switch such as switch 104 which is electrical communication with the controller 72, a signal can be provided to processor 72 and/or a computer therefore advising of the successful receipt of a return 18. Once the return 18 passes past the stop plate 102, and/or the stop plate 86 and/or the stop latches 88,90,92 the stop latches 88,90,92 and/or others can reset along with the stop plate 102 therefore preventing the returns 18 from being removed and being ready to block again in the blocking configuration. Returns 18 progress to be sequentially stored at recovery station which provides for access in a recovery configuration by an operator. Door 65 can be opened to allow access. After recovery, the door 65 can be shut and/or locked in some embodiments in an in-use configuration.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A kiosk for receiving return bottles, the kiosk comprising:

a return station having an opening sized to receive bottles having a predetermined cross-sectional shape;

a recovery station positioned below the return station;

one or more tracks extending between the return station and the recovery station, wherein the tracks are configured to direct the bottles from the return station to the recovery station using gravity; and a dispensing station positioned between the return station and the recovery station, wherein the dispensing station is configured to store a plurality of full bottles available for purchase at the kiosk.

2. The kiosk of claim 1 wherein the opening includes a perimeter shaped to receive horizontally oriented bottles.

3. The kiosk of claim 1 wherein the tracks are configured to support the bottles rolling on a side surface in a horizontal orientation.

4. The kiosk of claim 1 wherein the tracks include side directors configured to support dispensing ends of the bottles.

5. The kiosk of claim 1 wherein the return station comprises:

a latch proximate the opening and configured to contact an exterior portion of a bottle as it is received in the opening; and a stop plate operably coupled to the latch, wherein the stop plate is configured to restrict access through the opening until the latch contacts the exterior portion of the bottle.

6. The kiosk of claim 1, further comprising a door configured to restrict access to the bottles stored at the recovery station when the recovery station is in an in-use mode and allow access to the bottles when the recovery station is in a recovery mode.

7. The kiosk of claim 1 wherein the tracks comprise:

a first stage extending between a first point proximate the opening and a second point positioned laterally apart from and vertically below the first point;

a second stage extending from the second point to a third point vertically below the second point; and a third stage extending from the third point to a fourth point proximate the recovery station, wherein the third point is positioned laterally apart from and vertically above the fourth point.

8. The kiosk of claim 1, further comprising a processor configured to identify positions of at least some of the bottles received by the kiosk and indicate when the kiosk is at least partially full of received bottles.

9. The kiosk of claim 1 wherein:

the return station, the recovery station, and the dispensing station are positioned at the same side of the kiosk;

the perimeter of the opening is configured to receive individual bottles in a horizontal orientation;

the return station includes a stop plate at least partially blocking the opening and a plurality of latches at the opening and operably coupled to the stop plate, wherein the stop plate moves away from the opening in response to the plurality of latches contacting the bottles having the predetermined cross-sectional shape;

the recovery station has an in-use configuration wherein the recovery station is not accessible from the exterior of the kiosk by consumers and a recovery configuration wherein the recovery station is accessible from the exterior of the kiosk by an operator; and the tracks direct the bottles in a sequential order from the return station to the recovery station, the tracks being configured to maintain the bottles in the horizontal orientation from the return station to the recovery station.

10. The kiosk of claim 1, further comprising:

a processor configured to detect receipt of the bottles at the return station; and a ticket dispenser operably coupled to the processor and configured to dispense a ticket in response to receipt of the bottles.

11. The kiosk of claim 1 wherein the dispensing station includes a plurality of head receivers, each head receiver being configured to retain an upper portion of one of the full bottles units and prevent removal of the full bottles.

12. The kiosk of claim 11, further comprising a processor operably coupled to the head receivers, the processor being configured to release one of the stocked units from the corresponding head receiver after receiving payment for the stocked unit and identify when a supply of the stocked units is depleted via signals from the head receivers.

13. The kiosk of claim 1 wherein the kiosk has a footprint, and wherein at least a portion of the recovery station and at least a portion of the dispensing station are within the same portion of the footprint.

14. A kiosk for receiving empty containers from consumers, the kiosk comprising:

a return station having a means for receiving empty containers having a predetermined cross-sectional shape and reject empty containers not having the predetermined cross-sectional shape;

a recovery station positioned below the return station, wherein the recovery station is configured to provide access to the empty containers by an operator when the kiosk is in a recovery configuration;

one or more guides that direct the empty bottles in a horizontal orientation from the return station to the recovery station; and a dispensing station spaced vertically between the return station and the recovery station, wherein the dispensing station is configured to store a plurality of full containers available for purchase at the kiosk, and wherein at least a portion of the dispensing station occupies the same surface space as at least one of the return station or the recovery station.

15. The kiosk of claim 14 wherein the means for receiving empty containers includes an opening having a perimeter at least generally defined by the predetermined cross-sectional shape, and wherein the opening is configured to receive empty containers in a horizontal orientation.

16. The kiosk of claim 14 wherein the means for receiving empty containers includes a latch having a blocking configuration and an accept configuration, wherein the latch moves from the blocking configuration to the accept configuration when the latch contacts a predetermined portion of an empty container and moves back to the blocking configuration after the empty container passes by the latch.

17. The kiosk of claim 14 wherein the means for receiving empty containers includes an opening having a perimeter defined by a predetermined size of a horizontally oriented empty water bottle.

18. The kiosk of claim 14 wherein the kiosk has a front side and a back side, wherein the return station and the recovery station are at the front side, and wherein the guides include:

a first stage for directing the empty containers from the return station at the front side toward the back side;

a second stage proximate the back side; and a third stage for directing bottles from the second stage to the recovery station at the front side, and wherein the second stage is configured to direct the empty containers from the first stage to the third stage.

19. The kiosk of claim 14, further comprising a processor operably coupled to the return station, wherein the processor is configured to detect receipt of empty containers via the return station and indicate to an operator when the kiosk should be emptied of the empty containers.

20. The kiosk of claim 14 wherein the return station, the recovery station, and the dispensing station are at a front side of the kiosk, and wherein the guides direct the empty containers from the return station at the front side of the kiosk toward a back side of the kiosk behind the dispensing station, and then forward toward the recovery station.

21. A method of receiving empty bottles at a kiosk, the method comprising:

receiving bottles having a predetermined cross-sectional shape via a return station of the kiosk;

rejecting, via the return station, bottles having a cross-sectional shape different from the predetermined cross-sectional shape;

directing the received bottles from the return station to a recovery station positioned below the return station;

storing the received bottles in the kiosk, wherein the received bottles are removable from the kiosk at the recovery station when the kiosk is in a recovery configuration that allows an operator to remove the bottles;

detecting the receipt of a bottle at the return station; and dispensing a ticket to a consumer via a ticket dispenser, the ticket having a value associated with the received bottle.

22. The method of claim 21 wherein receiving bottles having the predetermined cross-sectional shape comprises receiving bottles in a horizontal orientation through an opening having a perimeter at least generally similar to the predetermined cross-sectional shape.

23. The method of claim 21 wherein receiving bottles having the predetermined cross-sectional shape comprises:

contacting a portion of each bottle with one or more latches at the return station; and moving a stop plate away from the return station in response to the latches contacting the portion of the bottle.

24. A method of receiving empty bottles at a kiosk, the method comprising:

receiving bottles having a predetermined cross-sectional shape via a return station of the kiosk;

rejecting, via the return station, bottles having a cross-sectional shape different from the predetermined cross-sectional shape;

directing the received bottles from the return station to a recovery station positioned below the return station;

storing the received bottles in the kiosk, wherein the received bottles are removable from the kiosk at the recovery station when the kiosk is in a recovery configuration that allows an operator to remove the bottles;

storing full bottles at a dispensing station positioned between the recovery station and the return station;

receiving payment for at least one of the full bottles; and releasing the at least one full bottle from the dispensing station.

25. The method of claim 24 wherein directing the received bottles comprises moving the received bottles along one or more tracks from the return station to the recovery station, wherein the tracks support the received bottles in a horizontal orientation.

26. The method of claim 24 wherein the return station and the recovery station are positioned at a front side of the kiosk, and wherein directing the received bottles comprises:

directing the received bottles from the return station toward a back side of the kiosk;

moving the received bottles downward in a generally vertical direction proximate the back side of the kiosk; and directing the received bottles from the back side of the kiosk to the recovery station at the front side.

* * * * *